United States Patent [19]

Gehrig et al.

[11] 4,126,239

[45] Nov. 21, 1978

[54] CANISTER FOR AQUEOUS GEL EXPLOSIVE PRIMER

[75] Inventors: Neil E. Gehrig, Westwood Hills, Kans.; Fred Broussard, Bridge City; Frank J. Barborek, Orange, both of Tex.

[73] Assignee: Gulf Oil Corporation, Pittsburgh, Pa.

[21] Appl. No.: 857,542

[22] Filed: Dec. 5, 1977

[51] Int. Cl.[2] ..... B65D 1/04

[52] U.S. Cl. ..... 215/6; 220/20; 206/3

[58] Field of Search ..... 206/3; 215/6; 220/20, 220/20.5, 22

[56] References Cited

U.S. PATENT DOCUMENTS

| | | | |
|---|---|---|---|
| 776,140 | 11/1904 | Manahan | 215/6 |
| 1,728,883 | 9/1929 | Simon | 215/6 |
| 2,371,448 | 3/1945 | Kendig | 215/6 |
| 2,753,990 | 7/1956 | Chalfin | 215/6 |

FOREIGN PATENT DOCUMENTS

| | | | |
|---|---|---|---|
| 616,581 | 10/1925 | France | 215/6 |

*Primary Examiner*—Ro E. Hart
*Attorney, Agent, or Firm*—Carl A. Cline

[57] ABSTRACT

A canister for an explosive primer containing capsensitive aqueous gel explosive is formed from a thermoplastic by blow-molding a pair of semi-cylindrical bottles connected by an integral hinge which have one or more corresponding grooves in their mating flat longitudinal surfaces. When the flat surfaces of the two containers are placed in contact and the containers are fastened together to form a cylinder, the matching grooves form a central longitudinal tubular passage through the canister and, if desired, one or more cylindrical wells in close proximity to the central passage.

3 Claims, 2 Drawing Figures

CANISTER FOR AQUEOUS GEL EXPLOSIVE PRIMER

BACKGROUND OF THE INVENTION

In the use of relatively insensitive, low cost industrial explosives based on ammonium nitrate-fuel combinations it is usually necessary to use primers or booster charges containing some sort of high explosive in order to obtain efficient detonation. Otherwise a substantial portion of the ammonium nitrate is often undecomposed after the explosion. In the past both dynamite and primers of cast solid high explosive have been used. The high explosive materials are conventionally melted and poured into containers of the type exemplified by U.S. Pat. Nos. 3,183,836 and 3,604,353. The containers, or canisters for the cast high explosive primers are usually fitted with a lid or cap which is pressed on after the molten explosive has cooled and solidified.

There have recently become available cap-sensitive aqueous gel ammonium nitrate explosives which would be desirable for use in primers. U.S. Pat. No. 3,962,001 discloses an explosive of this type. Unfortunately the explosive primer canisters which are already in use are unsuitable for aqueous gel explosive. Having been designed for melt-casting high explosive compositions, they are difficult to fill with an aqueous gel or do not have enough structure to hold a gel while retaining their physical shape. In general they are also too small for the purpose. The fabrication of a cylindrical canister with an open central longitudinal passage and adjacent well for a detonator presents difficulties, particularly when it is necessary to make the container longer than conventional primers, and make it contain a shapeless gel. Prior art designs for waterproof or leak-proof primer canisters, as in U.S. Pat. No. 3,354,827 have been difficult to seal and have required too much hand assembly at the blasting site.

SUMMARY OF THE INVENTION

We have invented a canister for an aqueous gel explosive primer which consists of a matching pair of molded plastic semi-cylindrical bottles which have corresponding longitudinal grooves in their flat longitudinal surfaces, so that when the two flat surfaces are placed together and fastened in place to form a cylindrical canister, the corresponding grooves come together to form a central longitudinal tubular passage and if desired, at least one cylindrical well in close proximity to the central tubular passage. In FIG. 1 there is illustrated the pair of blow-molded plastic bottles before fastening together and FIG. 2 shows the completed canister assembly.

DETAILED DESCRIPTION

Figure 1:
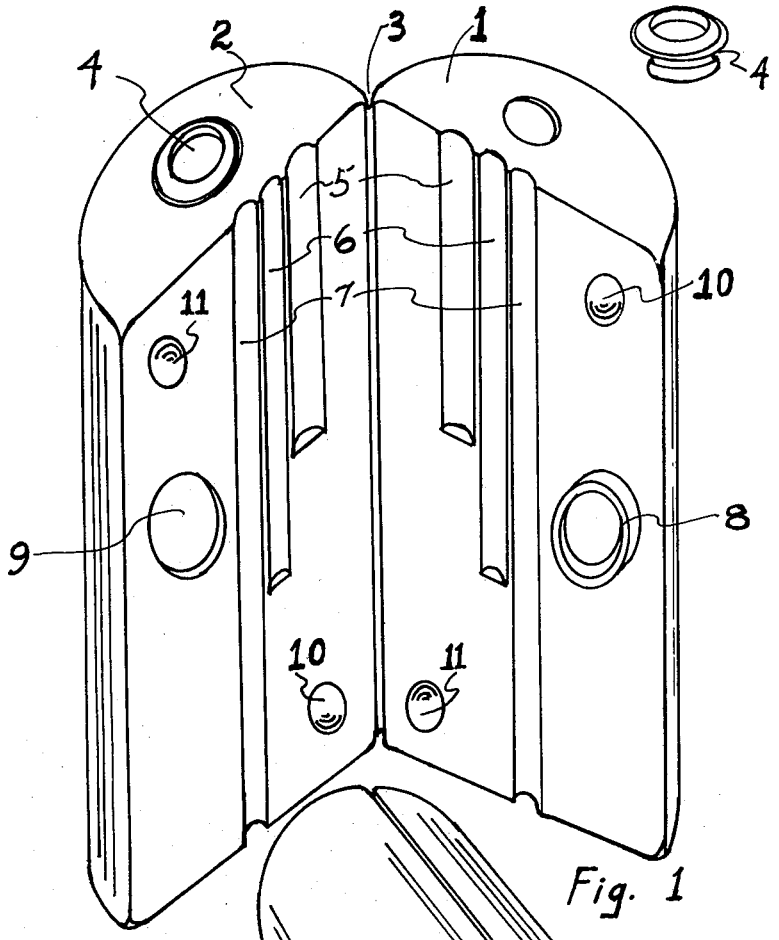

The primer canister may be readily understood by reference to the drawing. In FIG. 1 are shown the pair of blow-molded plastic bottles, which are matching right (1) and left (2) semi-cylindrical shape joined by a plastic hinge (3) which is formed in the mold. Both bottles are fitted with closures (4) to retain the contents. The illustrated closures form a tight seal when pressed into openings in the ends of the bottles. Screw caps or other sealable closures may also be employed.

Figure 2:
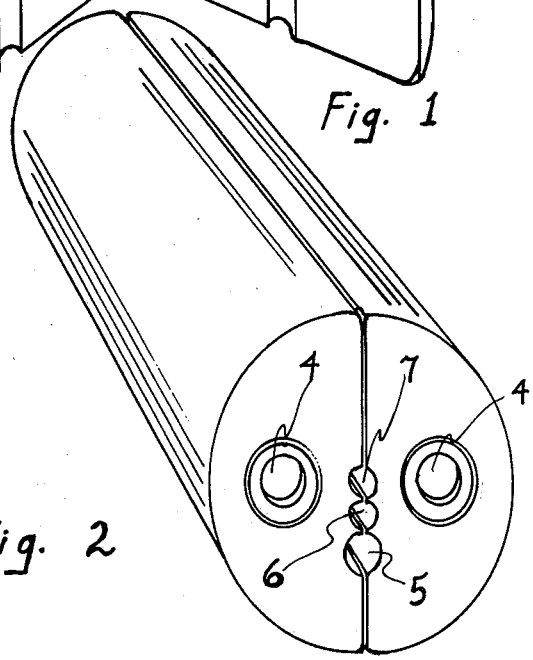

Corresponding pairs of grooves (5, 6 and 7) form tubular passages when the two bottles are fastened together to form a cylindrical canister, as shown in FIG. 2. The two semi-cylindrical bottles may be fastened together with a heat-shrinkable thermo plastic sleeve, an adhesive tape, adhesive label, a rubber band, a suitable adhesive, or by heat-sealing flanges incorporated in the edges of the plastic bottles. To aid in propagation of the explosion and in obtaining a perfectly corresponding fit of the semi-cylindrical halves of the canister, there are incorporated a male conduit, (8) and corresponding aperture (9) in the flat faces of the blow-molded bottles, which fit together when the canister is assembled. In this way the entire mass of explosive is kept in physical contact and the two halves of the canister are securely positioned in perfect alignment. Raised areas (10) and corresponding depressions (11) may also be incorporated in the shape of the flat sides of the bottles as an aid to speedy alignment during assembly.

Preferably, the canister is formed in a diameter which is convenient for use in the boreholes in which explosive charges are being placed. The length of the canister may vary with the desired capacity for gel explosive. Commonly the canister will be from about 5 to 10 cm in diameter and will have a capacity of from about one-fourth to about two kilograms of explosive.

The matching grooves in the flat longitudinal surfaces of the semi-cylindrical bottles are preferably, but not necessarily semi-cylindrical in shape. Round tubular passages for inserting detonating cord and blasting caps are in conformity with the normal practice in the industry and semi-cylindrical grooves are therefore preferred.

The canister may be made readily distinguishable by sight and feel from the cast high explosive primers which are in common use. The aqueous gel explosive is not impact-sensitive and may be handled with greater safety. It is desirable from the standpoint of safety that workmen are aware of the difference and use suitable precautions when changing from one type of primer to the other. Distinctive labels may be employed to call attention to the difference in explosive properties and a distinctive texture may be molded into the exterior surface of the canister for the same purpose. The use of non-pigmented translucent plastic for the canister also permits the color and texture of the explosive to be visible, so that the aqueous gel composition is easily recognizable.

The primer canister of the present invention is designed for machine assembly or for hand assembly with the minimum amount of time and care. The combination of the integral hinge and the male conduits with corresponding apertures makes it possible to position the two semi-cylindrical bottles in perfect alignment without handling separate parts or exercising care in assembly. The canister halves may be folded together and heat-sealed at the edges opposite the hinge immediately after the blow-molding and trimming operations. The canister is then ready for filling with aqueous gel explosive and insertion of the sealing plugs.

It will be appreciated that when the canister is assembled the flat surfaces of the two semi-cylindrical halves are in alignment, but there will be a small air gap between them, including the areas where the corresponding grooves form the longitudinal passage and cylindrical wells, as can be seen in FIG. 2 of the drawing. This is not an imperfection in the design, but is a feature which contributes to the efficiency of detonation. The small air gaps in the walls of the cylindrical passages facilitate the initiation of explosion of the detonating cord secondary initiator when either a detonating cap or detonating cord is used as primary initiator in one of the other passages. The air gap does not detract from propagation of the explosion through the aqueous gel explosive because of the continuity of the mass provided by the conduit between the two halves of the canister.

It will also be appreciated that the communicating conduits and the sealing plugs of the canister do not necessarily form absolutely leakproof seals. However, the aqueous gel explosive is so viscous it cannot leak through a small opening and it is water-resistant, so that it is unnecessary to make a canister which is perfectly waterproof.

We claim:

1. A canister for an aqueous gel explosive primer which comprises a pair of semi-cylindrical plastic bottles joined by an integral hinge along one longitudinal edge of each bottle, said bottles having corresponding grooves in their mating flat longitudinal surfaces so that when the flat surfaces are brought together to form a cylindrical structure the corresponding grooves come together to form a central longitudinal tubular passage through the canister and one or more cylindrical cavities in close proximity to said central longitudinal tubular passage.

2. A canister according to claim 1 in which there is a connecting conduit between the pair of semi-cylindrical bottles when the flat longitudinal surfaces are brought together to form a cylindrical structure.

3. A canister according to claims 1 or 2 which is filled with a cap-sensitive aqueous gel explosive.

* * * * *